US007261651B2

(12) United States Patent
Kasashima et al.

(10) Patent No.: US 7,261,651 B2
(45) Date of Patent: Aug. 28, 2007

(54) GOLF BALL

(75) Inventors: Atsuki Kasashima, Chichibu (JP); Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/304,807

(22) Filed: Dec. 16, 2005

(65) Prior Publication Data

US 2007/0142129 A1 Jun. 21, 2007

(51) Int. Cl.
*A63B 37/14* (2006.01)

(52) U.S. Cl. ..... 473/383

(58) Field of Classification Search ..... 473/378–385
See application file for complete search history.

(56) References Cited

U.S. PATENT DOCUMENTS 5,005,838 A 4/1991 Oka
5,759,116 A * 6/1998 Kasasima et al. ..... 473/384
5,800,287 A * 9/1998 Yokota et al. ..... 473/372

FOREIGN PATENT DOCUMENTS

JP 2-295573 A 12/1990
JP 4-117969 A 4/1992

* cited by examiner

*Primary Examiner*—Raeann Trimiew
(74) *Attorney, Agent, or Firm*—Sughrue Mion, PLLC

(57) ABSTRACT

In a golf ball having a spherical surface with numerous dimples thereon, the dimples have a diameter of 2 to 6 mm and number in all from 250 to 330, of which at least 60% are large dimples having a diameter of at least 4.5 mm. The volume of space in a dimple below a planar surface circumscribed by an edge of the dimple, summed for all the dimples on the surface of the ball, is from 320 to 360 mm$^3$. The golf ball rises well when hit and is easy even for an inexperienced golfer to hit.

5 Claims, 4 Drawing Sheets

GOLF BALL

BACKGROUND OF THE INVENTION

The present invention relates to a golf ball that rises well when hit and is easy even for an inexperienced golfer to hit. The invention relates more particularly to a golf ball highly suitable for use in practice such as on a golf driving range.

Beginners playing round golf frequently have the experience during play on a golf course of being unable to get as much height on the ball as they would like when using a distance club such as a driver or fairway wood. As a result, the ball flies low or lands too early, so that the player is unable to get the anticipated distance.

On the other hand, at golf practice ranges, particularly those located within or near a city, use is often made of what is sometimes referred to as an "urban golf course." These are sites of limited size, due to conditions imposed by the location, that are surrounded by golf ball netting. There is a risk that the golf balls used at such a golf practice range may, when hit, follow an ordinary trajectory and pass over the netting, posing a danger to the surrounding area.

It is thus necessary, when golf balls are used at a practice range, to shorten the distance traveled by the ball. Specifically, one common approach is to increase the volume of the dimples and thus enlarge the aerodynamic resistance of the ball. However, on shots taken with such a ball, the ball has too low a trajectory, as a result of which the path of the ball does not feel right to the player.

SUMMARY OF THE INVENTION

Therefore, an object of the invention is to provide a golf ball which rises well when hit with a distance club such as a driver, and which follows a trajectory that feels right to the player.

We have conducted extensive investigations aimed at achieving the above object, as a result of which we have focused on the dimple diameter, total number of dimples and dimple space volume in a golf ball having a spherical surface with numerous dimples thereon. Specifically, we have discovered that, by carrying out dimple design so that the dimples have a diameter of 2 to 6 mm and number in all from 250 to 330, of which at least 60% are large dimples having a diameter of at least 4.5 mm, and so that the volume of space in a dimple below a planar surface circumscribed by an edge of the dimple, summed for all the dimples on the surface of the ball, is from 320 to 360 $mm^3$, contrary to expectations, even when the ball is struck with a club such as a driver, the shot rises well and is able to follow a trajectory that feels right to the player. Such a golf ball is particularly well-suited for use on golf practice ranges of a limited size.

Accordingly, the invention provides the following golf balls.

[1] A golf ball having a spherical surface with numerous dimples thereon, the ball being characterized in that the dimples have a diameter of 2 to 6 mm and number in all from 250 to 330, of which at least 60% are large dimples having a diameter of at least 4.5 mm, and in that the volume of space in a dimple below a planar surface circumscribed by an edge of the dimple, summed for all the dimples on the surface of the ball, is from 320 to 360 $mm^3$.

[2] The golf ball of [1] above, wherein the value obtained when the volume of space in the dimple below the planar surface circumscribed by the dimple edge is divided by the volume of a cylinder whose base is the planar surface and whose height is the maximum depth of the dimple from the base, averaged for all the dimples, is from 0.40 to 0.49.

[3] The golf ball of [1] above wherein, on a wall of a dimple as seen in cross-section, letting positions at 70% of the maximum depth of the dimple from the dimple edge be A and A and letting a position of maximum depth be B, an imaginary arc which passes through positions A and B and A has a radius of curvature $R_b$ of 5 to 40 mm.

[4] The golf ball of [1] above wherein, on a wall of a dimple as seen in cross-section, the angle between a tangent at the wall that passes through a position C at 30% of the maximum dimple depth from the dimple edge and a line segment that connects both dimple edges is from 4 to 20°.

BRIEF DESCRIPTION OF THE DIAGRAMS

DETAILED DESCRIPTION OF THE INVENTION

The invention is described more fully below in conjunction with the attached diagrams.

Figure 1:
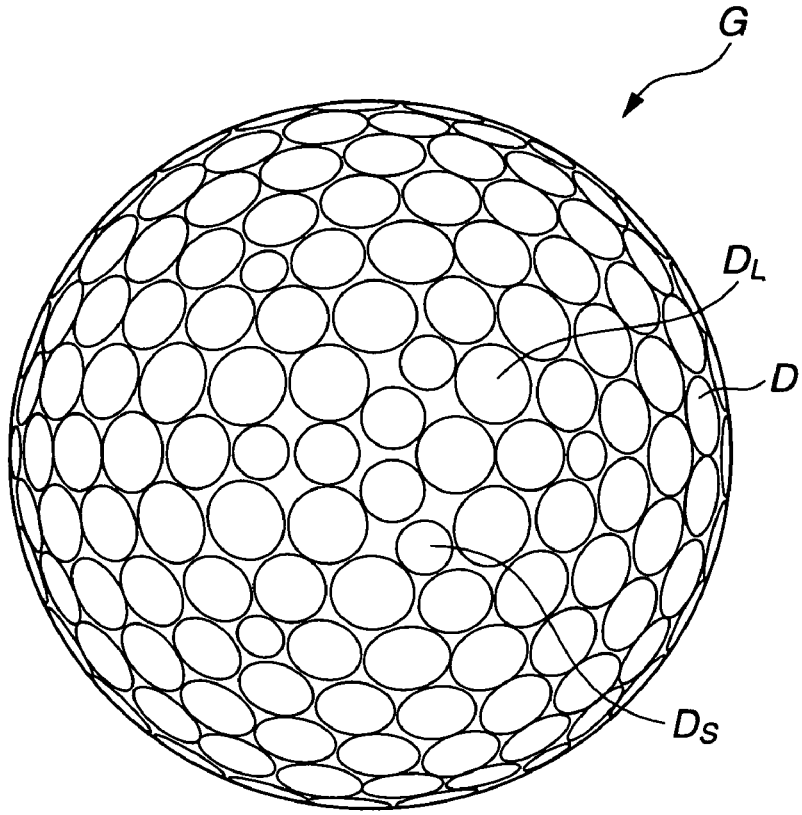
FIG. 1 is a top view showing the dimple configuration on the golf ball obtained in Example 1.
Figure 2:
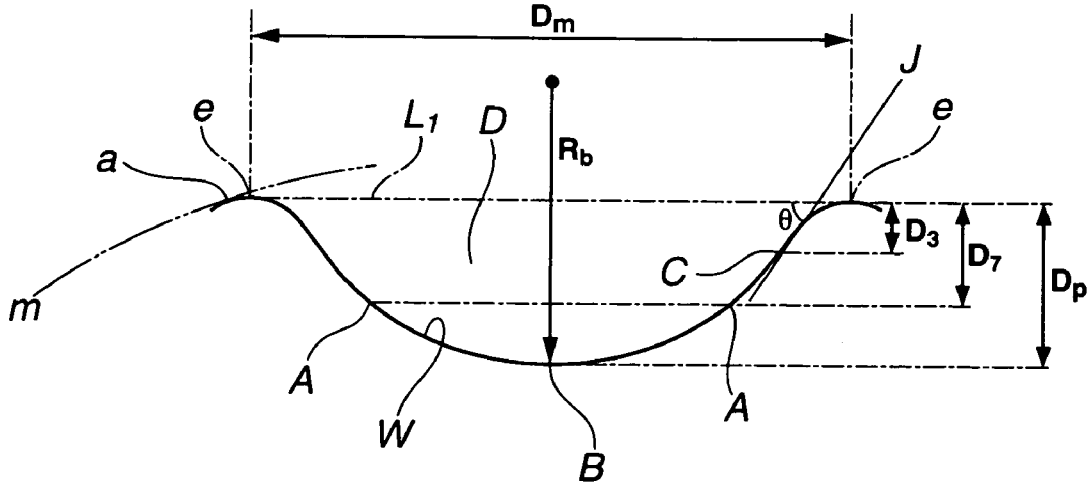
FIG. 2 is an enlarged, sectional view of a dimple on the ball in FIG. 1.
Figure 3:
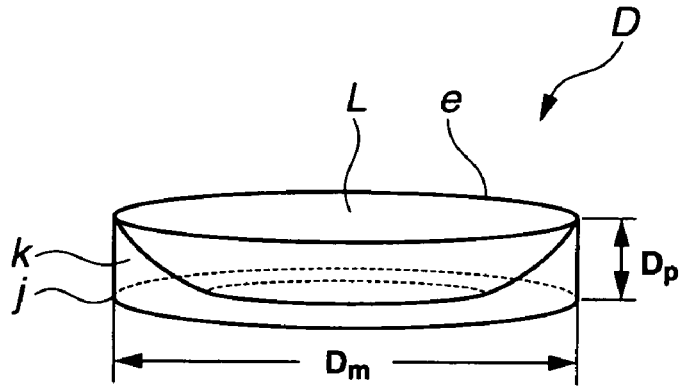
FIG. 3 is a diagram illustrating the dimple space volume $V_o$.

FIG. 1 is a top view of a golf ball showing a first embodiment of the invention, FIG. 2 is an enlarged, sectional view of a dimple on the same ball, and FIG. 3 is an enlarged, perspective view of the dimple.

In these diagrams, the golf ball G has a spherical surface with numerous dimples D thereon. The dimples have a diameter Dm of 2 to 6 mm, and number in all from 250 to 330, of which at least 60% are large dimples $D_L$ having a diameter Dm of at least 4.5 mm. In this embodiment, the dimples have a planar shape that is circular. If the planar shape of the dimples is a non-circular shape such as a polygonal shape, the span across the dimple is used in place of the diameter. The volume of space in the dimple below a planar surface circumscribed by an edge e of the dimple, summed for all the dimples on the surface of the ball, is from 320 to 360 $mm^3$. To provide a well-balanced arrangement of dimples, it is preferable for the upper limit in the number of large dimples having a diameter Dm of at least 4.5 mm, as a proportion of all the dimples, to be set at 85%. Moreover, it is preferable for the sum of the spatial volume for all the dimples on the surface of the ball to be from 325 to 350 $mm^3$.

In the practice of the art, the upper limit in the diameter of large dimples $D_L$ having a diameter of at least 4.5 mm is 6 mm, and the lower limit in the diameter of small dimples $D_s$ is 2 mm. Above or below these values, the roll of the ball on putts may be detrimentally affected. By arranging the dimples on the ball in a relatively small total number of 250 to 330 and setting the total spatial volume for all the dimples at from 320 to 360 $mm^3$, the distance traveled by the ball can be shortened while yet allowing the ball to follow a trajectory that feels right to the player.

It is preferable for the value $V_o$ obtained when the volume of the dimple space below a planar surface circumscribed by an edge e situated at the upper end of the dimple is divided by the volume of a cylinder whose base is the planar surface and whose height is the maximum depth $D_p$ of the dimple from the base, averaged for all dimples, to be from 0.40 to 0.49.

The value $V_o$ is explained more fully. As shown in FIG. 3, $V_o$ is determined based on the volume of space in a dimple below a planar surface L (a circle of diameter Dm) circumscribed by the dimple edge e. Letting the planar surface be the base j of a cylinder (that is, letting the base be the same as the above-described planar surface of the dimple), the volume of a cylinder whose height is the maximum dimple depth $D_p$ from the planar surface L is determined. The ratio of the volume of space in the dimple to the volume of the cylinder is the value $V_o$.

Next, as shown in FIG. 2, on a wall of a dimple as seen in cross-section, letting positions at 70% of the maximum depth $D_7$ of the dimple from the dimple edge e be A and A and letting a position of maximum depth be B, an imaginary arc which passes through positions A and B and A has a radius of curvature $R_b$ that is preferably 5 to 40 mm, and more preferably 7 to 30 mm.

The shape of the dimple bottom which includes positions A and B and A may or may not coincide with the arc passing through positions A and B and A.

As shown in FIG. 2, on a wall of the dimple as seen in cross-section, the angle between a tangent J at the wall that passes through a position C at 30% of the maximum dimple depth from the dimple edge e and a line segment $L_1$ that connects both dimple edges is preferably from 4 to 20°, more preferably from 5 to 12°, and even more preferably from 6 to 9°. Also, in FIG. 2, the region that continues outward from the edge e of the dimple D is a land region a, and the arc m represented by a dot-dash line that extends tangential to the apex of the land region a is a part of an imaginary circle which is located on the radially outermost side of the ball and extends tangential to the respective apices of the land regions.

Concerning the construction of the inventive golf ball, the ball may be a one-piece ball in which the entire ball is composed of a single resilient material such as synthetic rubber, or the ball may have a two-piece or multi-piece construction having a resilient core which is composed of a suitable material such as rubber and is enclosed within one or more resin cover layer. No particular limitation is imposed on the materials of which the core and cover in the internal structure of the golf ball are made. These materials may be composed primarily of any of various known synthetic resins or synthetic rubbers.

Ball characteristics such as ball weight and diameter can be suitably set in accordance with the Rules of Golf. The ball can generally be formed to a diameter of not less than 42.67 mm and a weight of not more than 45.93 g.

The arrangement of the dimples is also not subject to any particular limitation. For example, the dimples may be arranged in the manner of a spherical icosahedron, a spherical dodecahedron or a spherical octahedron, or may be given a random configuration.

EXAMPLES

The following Examples of the invention and Comparative Examples are provided by way of illustration and not by way of limitation.

Examples 1 to 3, Comparative Examples 1 to 4

Figure 4:
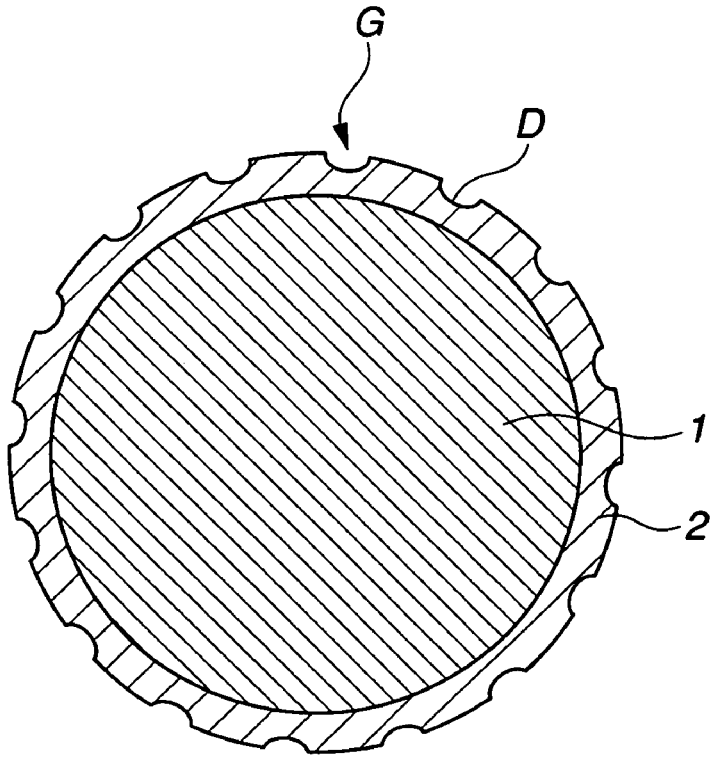
FIG. 4 is a cross-sectional view showing the inner structure of a two-piece golf ball.
Figure 5:
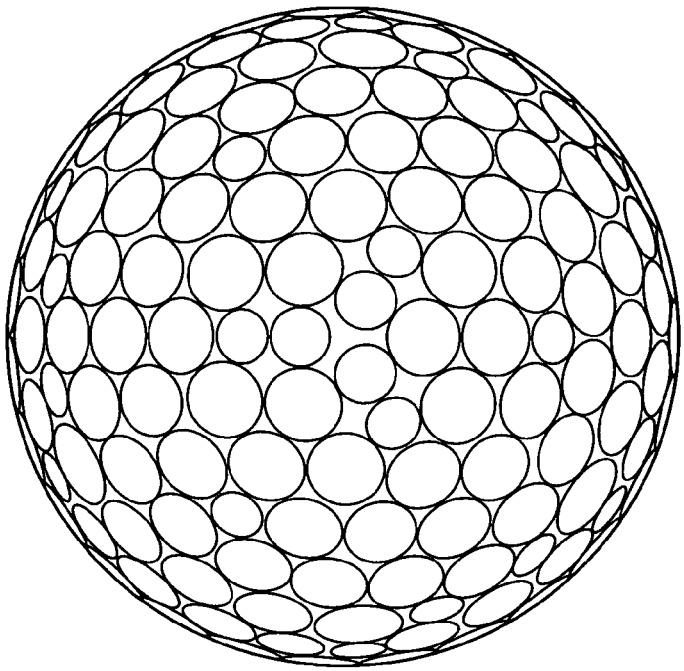
FIG. 5 is a top view showing the dimple configuration on the golf balls in Example 2 and Comparative Example 4.
Figure 6:
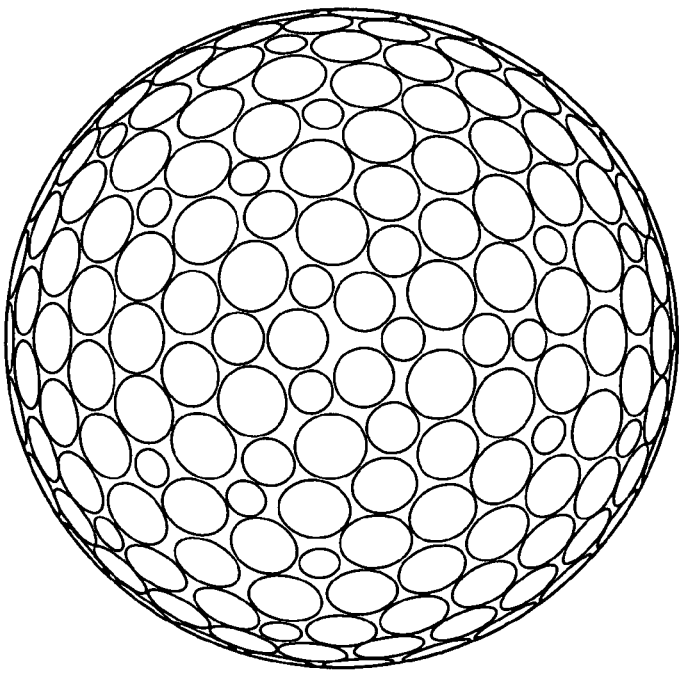
FIG. 6 is a top view showing the dimple configuration on the golf balls in Example 3 and Comparative Example 2.
Figure 7:
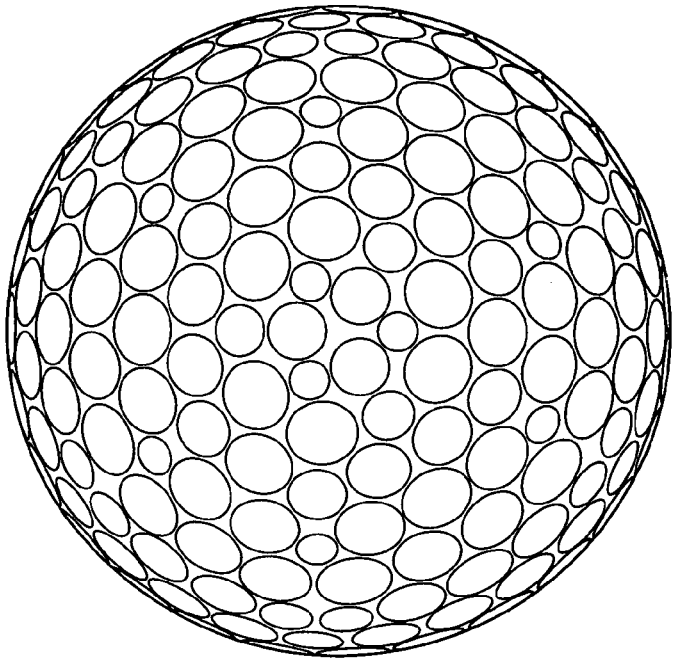
FIG. 7 is a top view showing the dimple configuration on the golf ball in Comparative Example 1.
Figure 8:
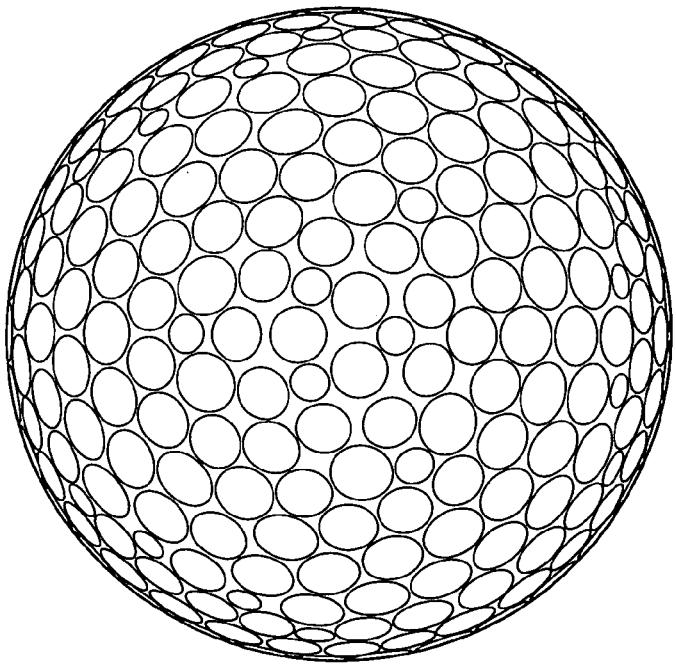
FIG. 8 is a top view showing the dimple configuration on the golf ball in Comparative Example 3.

Comparative tests were carried out on the flight properties of golf balls in Examples 1 to 3 and Comparative Examples 1 to 4 described below. In these tests, as shown in the cross-sectional diagram in FIG. 4, all of the balls had a two-piece solid construction G (ball diameter, 42.7 mm) composed of a 39.1 mm diameter solid core (single layer) 1 made of polybutadiene rubber, which core 1 is enclosed within a 1.8 mm thick single-layer ionomer resin cover 2. The respective examples of the invention and comparative examples had the dimple arrangements shown in the following indicated diagrams: Example 1 (FIG. 1), Example 2 (FIG. 5), Example 3 (FIG. 6), Comparative Example 1 (FIG. 7), Comparative Example 2 (FIG. 6), Comparative Example 3 (FIG. 8), Comparative Example 4 (FIG. 5).

Details of the dimples in these examples of the invention and comparative examples are presented in Tables 1 and 2 below.

TABLE 1

| | Type | Number | Diameter (mm) | Depth (mm) | Volume ($mm^3$) | Radius $R_b$ (mm) | Angle (°) | $V_o$ |
|---|---|---|---|---|---|---|---|---|
| Example 1 | 1 | 186 | 4.8 | 0.16 | 253.1 | 19 | 7.0 | 0.47 |
| (FIG. 1) | 2 | 66 | 4.4 | 0.15 | 70.8 | 16 | 7.3 | 0.47 |
| | 3 | 6 | 3.9 | 0.14 | 4.6 | 13 | 7.8 | 0.46 |
| | 4 | 6 | 3.4 | 0.14 | 3.4 | 10 | 8.9 | 0.44 |
| | 5 | 12 | 3.0 | 0.10 | 3.7 | 12 | 7.1 | 0.44 |
| | Total | 276 | | | 336 $mm^3$ | | | |
| Example 2 | 1 | 18 | 5.5 | 0.17 | 34.9 | 24 | 6.5 | 0.48 |
| (FIG. 5) | 2 | 12 | 5.1 | 0.17 | 20.0 | 10 | 7.1 | 0.48 |
| | 3 | 174 | 4.9 | 0.15 | 236.2 | 21 | 6.6 | 0.48 |
| | 4 | 24 | 4.2 | 0.15 | 22.9 | 14 | 7.7 | 0.46 |
| | 5 | 6 | 3.8 | 0.14 | 4.4 | 12 | 7.9 | 0.46 |
| | 6 | 36 | 3.4 | 0.13 | 19.1 | 10 | 8.1 | 0.45 |
| | Total | 270 | | | 338 $mm^3$ | | | |
| Example 3 | 1 | 12 | 4.8 | 0.16 | 16.7 | 19 | 7.1 | 0.48 |

TABLE 1-continued

| | Type | Number | Diameter (mm) | Depth (mm) | Volume ($mm^{3)}$ | Radius $R_b$ (mm) | Angle (°) | $V_o$ |
|---|---|---|---|---|---|---|---|---|
| (FIG. 6) | 2 | 210 | 4.6 | 0.16 | 268.0 | 17 | 7.4 | 0.48 |
| | 3 | 12 | 4.3 | 0.15 | 12.5 | 16 | 7.5 | 0.48 |
| | 4 | 24 | 4.1 | 0.13 | 19.4 | 16 | 6.8 | 0.47 |
| | 5 | 6 | 3.9 | 0.13 | 4.4 | 14 | 7.1 | 0.47 |
| | 6 | 12 | 3.5 | 0.13 | 6.9 | 12 | 8.0 | 0.46 |
| | 7 | 36 | 2.8 | 0.12 | 11.8 | 9 | 9.2 | 0.45 |
| | Total | 312 | | | 340 $mm^3$ | | | |

TABLE 1

| | Type | Number | Diameter (mm) | Depth (mm) | Volume ($mm^{3)}$ | Radius $R_b$ (mm) | Angle (°) | $V_o$ |
|---|---|---|---|---|---|---|---|---|
| Comparative Example 1 (FIG. 7) | 1 | 24 | 4.8 | 0.15 | 313.1 | 20 | 6.6 | 0.48 |
| | 2 | 180 | 4.6 | 0.14 | 201.0 | 20 | 6.5 | 0.48 |
| | 3 | 12 | 4.3 | 0.14 | 11.5 | 17 | 6.9 | 0.47 |
| | 4 | 24 | 4.1 | 0.14 | 21.2 | 15 | 7.3 | 0.47 |
| | 5 | 18 | 3.9 | 0.14 | 13.9 | 14 | 7.8 | 0.46 |
| | 6 | 30 | 3.7 | 0.14 | 20.6 | 12 | 8.1 | 0.45 |
| | 7 | 18 | 2.8 | 0.11 | 5.0 | 8 | 8.5 | 0.42 |
| | Total | 306 | | | 305 $mm^3$ | | | |
| Comparative Example 2 (FIG. 6) | 1 | 12 | 4.8 | 0.18 | 18.8 | 17 | 8.1 | 0.48 |
| | 2 | 210 | 4.6 | 0.18 | 301.5 | 15 | 8.5 | 0.48 |
| | 3 | 12 | 4.3 | 0.17 | 14.2 | 14 | 8.5 | 0.48 |
| | 4 | 24 | 4.1 | 0.17 | 25.3 | 13 | 9.1 | 0.47 |
| | 5 | 6 | 3.9 | 0.17 | 5.7 | 12 | 9.5 | 0.47 |
| | 6 | 12 | 3.5 | 0.15 | 8.0 | 10 | 9.3 | 0.46 |
| | 7 | 36 | 2.8 | 0.12 | 11.8 | 9 | 9.2 | 0.45 |
| | Total | 312 | | | 385 $mm^3$ | | | |
| Comparative Example 3 (FIG. 8) | 1 | 216 | 4.1 | 0.16 | 214.5 | 14 | 8.5 | 0.47 |
| | 2 | 144 | 3.7 | 0.15 | 109.2 | 12 | 8.8 | 0.47 |
| | 3 | 12 | 3.5 | 0.14 | 7.3 | 11 | 8.6 | 0.45 |
| | 4 | 36 | 2.5 | 0.11 | 8.4 | 6 | 9.5 | 0.43 |
| | Total | 408 | | | 339 $mm^3$ | | | |
| Comparative Example 4 (FIG. 5) | 1 | 18 | 5.5 | 0.10 | 29.1 | 75 | 9.0 | 0.68 |
| | 2 | 12 | 5.1 | 0.10 | 16.7 | 64 | 9.7 | 0.68 |
| | 3 | 174 | 4.9 | 0.10 | 223.1 | 59 | 10.0 | 0.68 |
| | 4 | 24 | 4.2 | 0.09 | 20.3 | 48 | 10.5 | 0.68 |
| | 5 | 6 | 3.8 | 0.09 | 4.2 | 40 | 11.6 | 0.68 |
| | 6 | 36 | 3.4 | 0.09 | 20.0 | 32 | 12.9 | 0.68 |
| | Total | 270 | | | 313 $mm^3$ | | | |

Notes:
1) $R_b$: The radius of curvature of an arc which passes through positions A and B and A on the wall of the dimple as seen in cross-section, where positions A and A are located at 70% of the maxmum depth $D_p$ of the dimple from the dimple edge and position B is located at the maximum depth.
2) Angle θ: The angle, on the wall of the dimple as seen in cross-section, between a tangent at the wall that passes through a position C at 30% of the maximum dimple depth $D_p$ from the dimple edge and a line segment that connects both dimple edges.
3) $V_o$: The value obtained when the volume of the dimple below a planar surface circumscribed by the edge of the dimple is divided by the volume of a cylinder whose base is the planar surface and whose height is the maximum depth of the dimple from the base.

Table 3 shows the test results obtained in the examples of the invention and the comparative examples.

TABLE 3

| | Example | | | Comparative Example | | | |
|---|---|---|---|---|---|---|---|
| | 1 | 2 | 3 | 1 | 2 | 3 | 4 |
| Angle of elevation (°) | 10.5 | 10.6 | 10.3 | 11.2 | 9.8 | 10.0 | 11.1 |
| Carry (m) | 210 | 211 | 212 | 215 | 205 | 209 | 216 |
| Total distance (m) | 220 | 220 | 221 | 225 | 216 | 221 | 224 |

Flight Performance

Each ball was hit at a head speed of 45 m/s with a driver (W#1) mounted on a swing robot, and both the carry of the ball and the total distance traveled by the ball were measured.

Angle of Elevation

Measured using a Portable SV (manufactured by Flovel Co., Ltd.).

The invention claimed is:

1. A golf ball comprising a spherical surface with numerous dimples thereon, the ball being characterized in that the dimples have a diameter of 2 to 6 mm and number in all from 250 to 330, of which at least 60% are large dimples having a diameter of at least 4.5 mm, and in that the volume of space in a dimple below a planar surface circumscribed by an edge of the dimple, summed for all the dimples on the surface of the ball, is from 320 to 360 $mm^3$, wherein the value obtained when the volume of space in the dimple below the planar surface circumscribed by the dimple edge is divided by the volume of a cylinder whose base is the planar surface and whose height is the maximum depth of the dimple from the base, averaged for all the dimples, is from 0.40 to 0.49.

2. The golf ball of claim 1, wherein, on a wall of a dimple as seen in cross-section, the angle between a tangent at the wall that passes through a position C at 30% of the maximum dimple depth from the dimple edge and a line segment that connects both dimple edges is from 4 to 20°.

3. A golf ball comprising a spherical surface with numerous dimples thereon, the ball being characterized in that the dimples have a diameter of 2 to 6 mm and number in all from 250 to 330, of which at least 60% are large dimples having a diameter of at least 4.5 mm, and in that the volume of space in a dimple below a planar surface circumscribed by an edge of the dimple, summed for all the dimples on the surface of the ball, is from 320 to 360 $mm^3$, wherein, on a wall of a dimple as seen in cross-section, letting positions at 70% of the maximum depth of the dimple from the dimple edge be A and A and letting a position of maximum depth be B, an imaginary arc which passes through positions A and B and A has a radius of curvature $R_b$ of 5 to 40 mm.

4. The golf ball of claim 3, wherein, on a wall of a dimple as seen in cross-section, the angle between a tangent at the wall that passes through a position C at 30% of the maximum dimple depth from the dimple edge and a line segment that connects both dimple edges is from 4 to 20°.

5. A golf ball comprising a spherical surface with numerous dimples thereon, the ball being characterized in that the dimples have a diameter of 2 to 6 mm and number in all from 250 to 330, of which at least 60% are large dimples having a diameter of at least 4.5 mm, and in that the volume of space in a dimple below a planar surface circumscribed by an edge of the dimple, summed for all the dimples on the surface of the ball, is from 320 to 360 $mm^3$, wherein, on a wall of a dimple as seen in cross-section, the angle between a tangent at the wall that passes through a position C at 30% of the maximum dimple depth from the dimple edge and a line segment that connects both dimple edges is from 4 to 20°.

* * * * *